US006652176B2

(12) United States Patent
Dumler

(10) Patent No.: US 6,652,176 B2
(45) Date of Patent: Nov. 25, 2003

(54) RESERVOIR AND APPLICATOR UNIT

(75) Inventor: Norbert Dumler, Ansbach (DE)

(73) Assignee: Geka Brush GmbH, Bechhofen (DE)

( * ) Notice: Subject to any disclaimer, the term of this patent is extended or adjusted under 35 U.S.C. 154(b) by 37 days.

(21) Appl. No.: 10/284,500

(22) Filed: Oct. 31, 2002

(65) Prior Publication Data

US 2003/0081982 A1 May 1, 2003

(30) Foreign Application Priority Data

Oct. 31, 2001 (DE) ..... 101 53 689

(51) Int. Cl.[7] ..... A46B 11/00
(52) U.S. Cl. ..... 401/125; 401/132; 401/123
(58) Field of Search ..... 401/123, 124, 401/125, 126, 129, 132, 133, 134, 282, 290; 132/317

(56) References Cited

U.S. PATENT DOCUMENTS 1,534,827 A * 4/1925 Aste ..... 401/18
4,854,760 A * 8/1989 Pike et al. ..... 401/134
5,117,848 A * 6/1992 Huang ..... 132/308
5,123,765 A * 6/1992 O'Connell et al. ..... 401/126
6,152,633 A * 11/2000 Kim et al. ..... 401/124
6,312,182 B1 11/2001 Dumler

* cited by examiner

*Primary Examiner*—Gregory L. Huson
*Assistant Examiner*—Huyen Le
(74) *Attorney, Agent, or Firm*—Browdy and Neimark

(57) ABSTRACT

In a reservoir and applicator unit, in particular for small quantities or testing purposes in the cosmetic or medicinal field, comprising a reservoir for the compound that is to be applied and an applicator to be united with the reservoir, it is provided that the reservoir, at a first end, has a recess, which is closed towards the interior of the reservoir, for accommodation of the applicator;

that the reservoir, at a second opposite end, is provided with a feed inlet and outlet;

it being possible to place the applicator, prior to use, from the first end of the reservoir onto the second end such that the applicator stands out freely from the reservoir and any compound in the reservoir can flow from the reservoir onto the applicator.

11 Claims, 6 Drawing Sheets

RESERVOIR AND APPLICATOR UNIT

BACKGROUND OF THE INVENTION

Field of the Invention

The invention relates to a reservoir and applicator unit, in particular for small quantities or for testing purposes in the cosmetic or medicinal field, comprising a reservoir for the compound to be applied and an applicator to be united with the reservoir.

Background Art

In the cosmetic field which special reference is made to by way of example, units of the generic type are familiar in the application of mascara to the eyebrows or of nail varnish to the nails. Nail varnish units regularly include a glass bottle on which to screw a cap with a brush as an applicator. Mascara units also comprise a reservoir for the mascara liquid, with an unscrewable cap having a stem and a brush that is formed by a plurality of bristles retained between intertwisted wire sections. Numerous additional designs of containers and applicators are known, for instance in the form of foam molded articles.

In the cosmetic field, the optical effect of a cosmetic product after application can hardly be seen from the description or presentation of a product so that very frequently, a user is disappointed at the effect of the cosmetic when applied. Moreover, cosmetic products such as nail varnish or mascara are frequently changed or selected to suit with certain occasions or outfits. Conventionally, users have to buy lots of varying mascara products, which is costly and accompanied with the risk of the products drying or otherwise becoming useless.

SUMMARY OF THE INVENTION

It is an object of the invention to embody a reservoir and applicator unit of the conception mentioned at the outset in such a way that it can be manufactured at a low cost and is easy to use so that it is suitable also for small quantities or testing purposes.

According to the invention this object is attained in that the reservoir, at a first end, has a recess that is closed towards the interior, lodging the applicator, and is provided with a feed inlet or outlet at a second opposite end, it being possible, prior to use, to place the applicator from the first end of the reservoir onto the second end so that the applicator stands out freely from the reservoir and any liquid can flow from the reservoir onto the applicator.

This can be put into practice easily and at a low cost by plastic injection molding, precluding any costs for complicated glass containers. The reservoir can be provided with a comparatively large feed inlet for liquid, semiliquid or slightly creamy compounds to be filled in easily and rapidly. The applicator does not dip into the compound prior to use, remaining unused and clean. Once manufactured and stored up, the unit can easily be put in working order.

Preferably, provision is made for the applicator to be disposed in a nozzle with a passage for the compound that is to be applied.

In particular, provision can be made for the passage to discharge between at least two brushes that serve as an applicator. Such a solution is described in detail for instance in U.S. Pat. No. 6,312,182. Providing two brushes side by side helps obtain an especially uniform and flat layer in an embodiment as a nail varnish unit, the user having an excellent overview so that controlled and defined application is possible.

In keeping with the invention, provision can be made for the nozzle to be lockable into place on the reservoir so that simple assembly is feasible in terms of manufacturing requirements.

In a preferred embodiment, the locking operation is irreversible, in which case predetermined breaking points are provided for instance in the form of a plurality of thin plastic ribs for the nozzle to be separated from the reservoir.

An especially simple solution is characterized in that the feed inlet and outlet is closed in such a way that it opens automatically upon placement of the nozzle and the applicator. In this regard, provision can be made for the feed inlet and outlet to be closed by a membrane or the like and for the nozzle to have a thorn that pierces the membrane upon placement of the nozzle onto the second end of the reservoir so that in this way liquid can flow from the reservoir towards the applicator.

Favorably, the thorn is formed around the passage towards the applicator.

For the liquid that is to be applied to flow towards the applicator, it is advantageously provided that at least sections of the reservoir are compressible.

For the user to be able easily and promptly to recognize the type and in particular color of the applicator within the reservoir, it is provided that the wall of the reservoir is transparent at least by sections or that it has the color of the compound contained therein.

The reservoir and nozzle are preferably made from plastic material—as mentioned—with various, per se familiar plastic materials being conceivable, preferably trogamide.

Details of the invention will become apparent from the ensuing description of a preferred embodiment, taken in conjunction with the drawing.

DESCRIPTION OF THE PREFERRED EMBODIMENT

Figure 2:
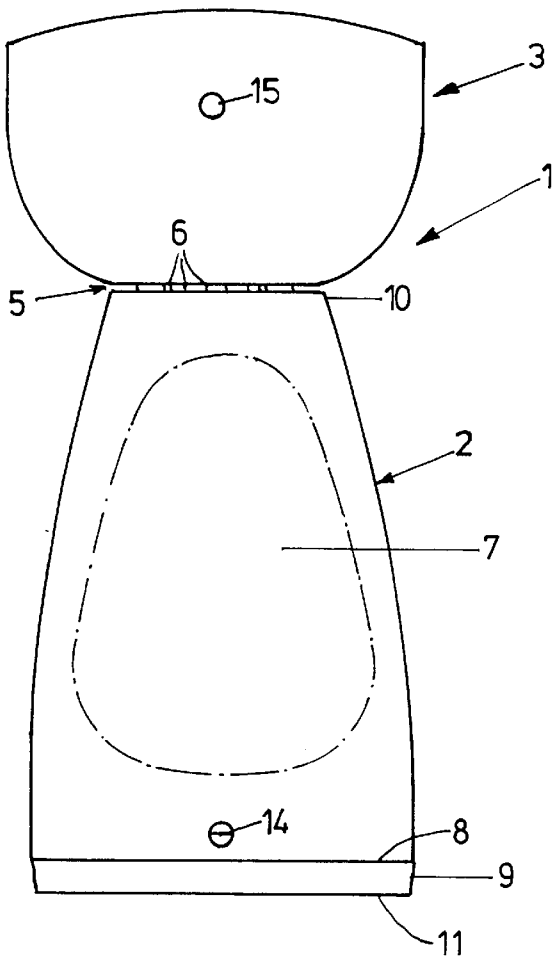
FIG. 2 is an elevation corresponding to FIG. 1.
Figure 1:
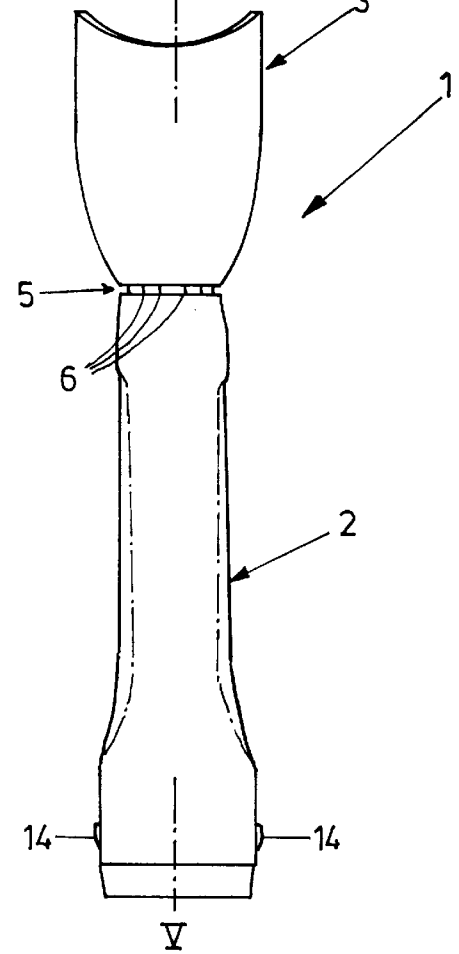
FIG. 1 is a side view of the reservoir and nozzle when united prior to being used.
Figure 4:
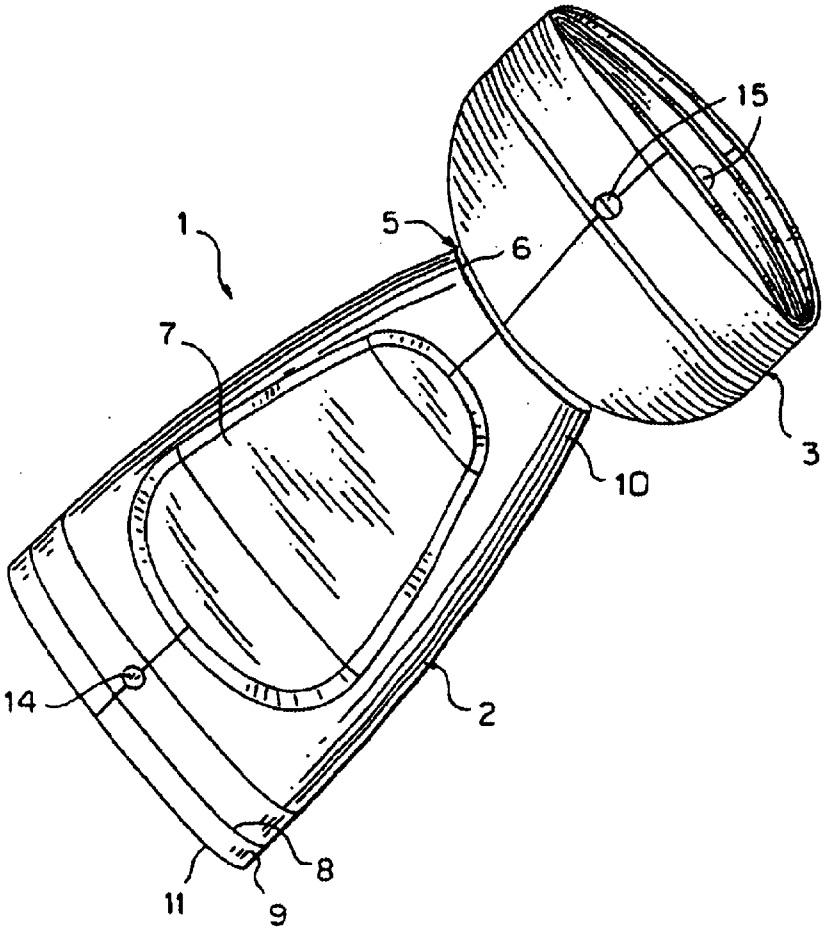
FIGS. 3 and 4 are perspective views, corresponding to FIG. 1, seen from various angles.
Figure 3:
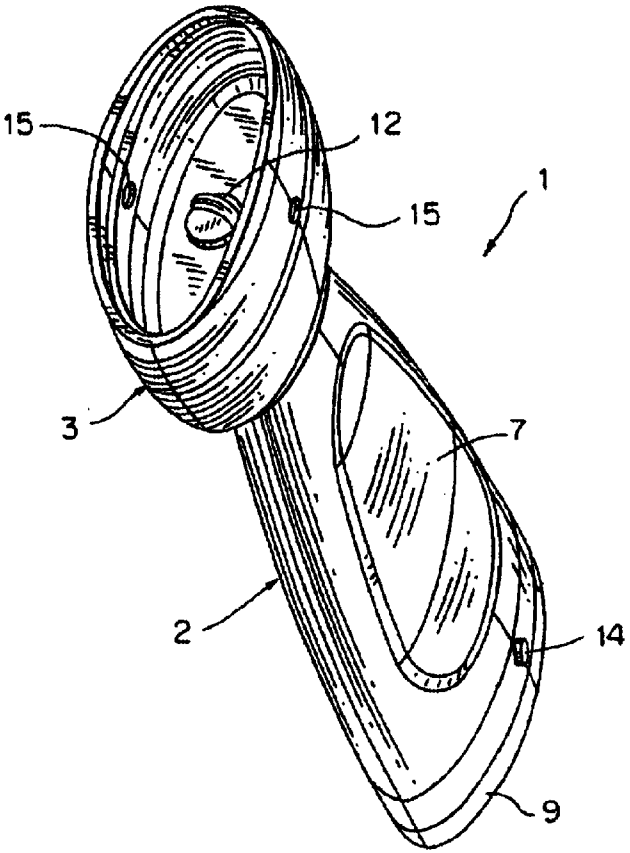

A unit 1 seen in the drawing comprises a reservoir 2 and a nozzle 3 which are nondetachably interlocked by locking noses and which are detachable along a rated break point 5 that comprises a plurality of ribs 6. The reservoir 2 has flexible walls 7 so that, when pressure is exercised, in the reservoir 2 may be pressed in the direction towards an outlet 8 which is formed on the second end 9 opposite the first end 10 where the nozzle 3 is placed. The outlet 8 works as a feed inlet and outlet and is closed by a membrane 11 after charging.

Figure 5:
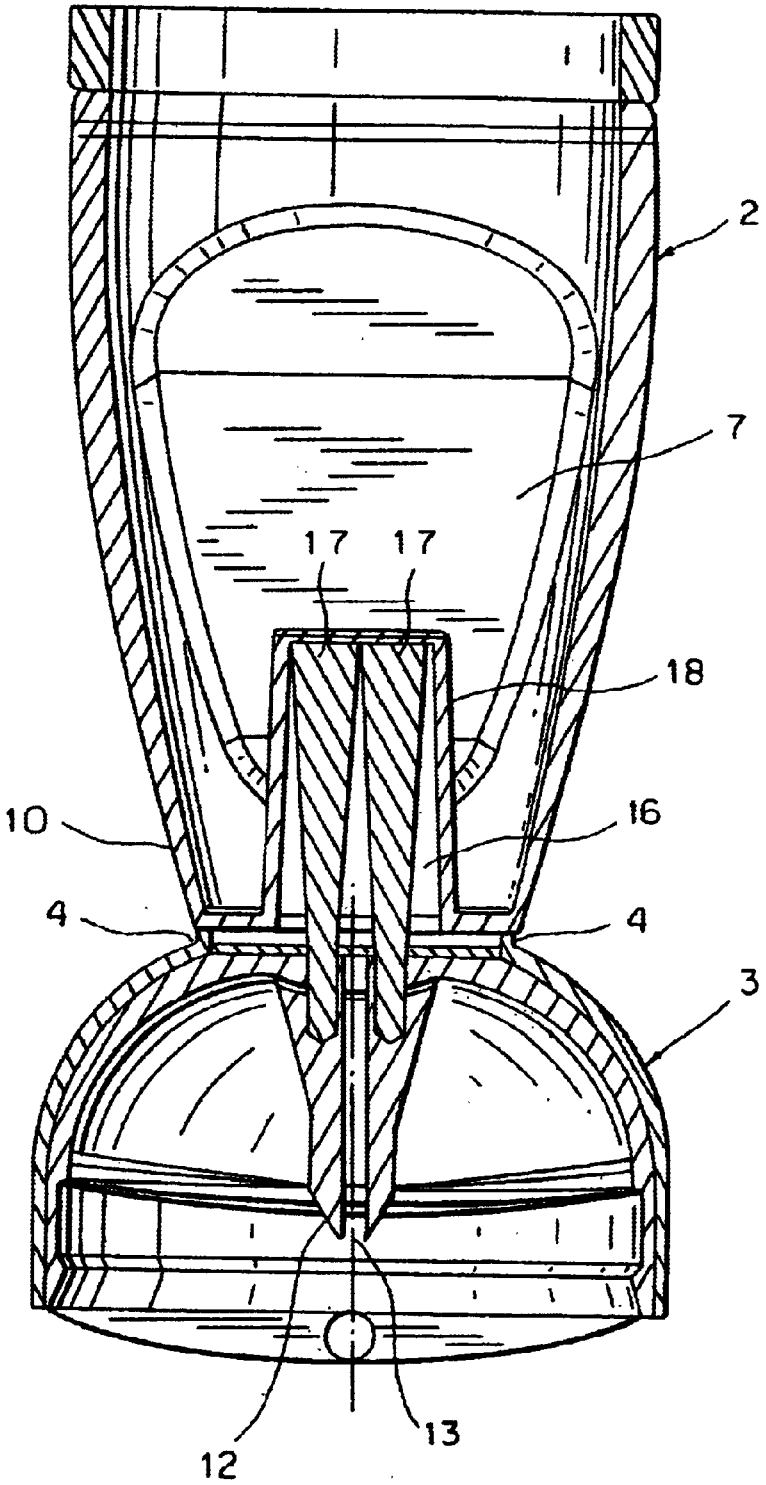
FIG. 5 is a section on the line V—V of FIG. 1.
Figure 6:
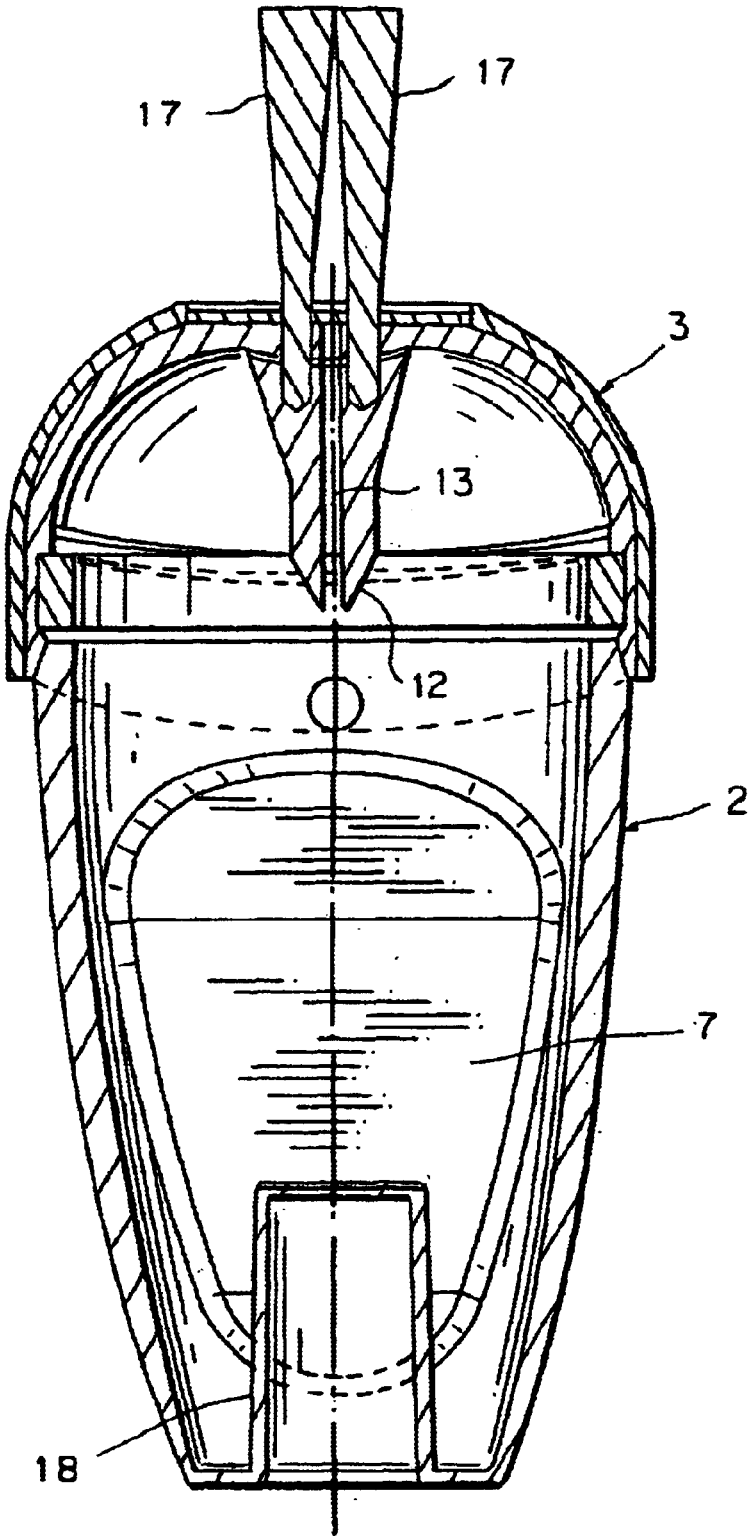
FIG. 6 is a longitudinal section, corresponding to FIG. 5, with the nozzle placed on the second end for use.
Figure 8:
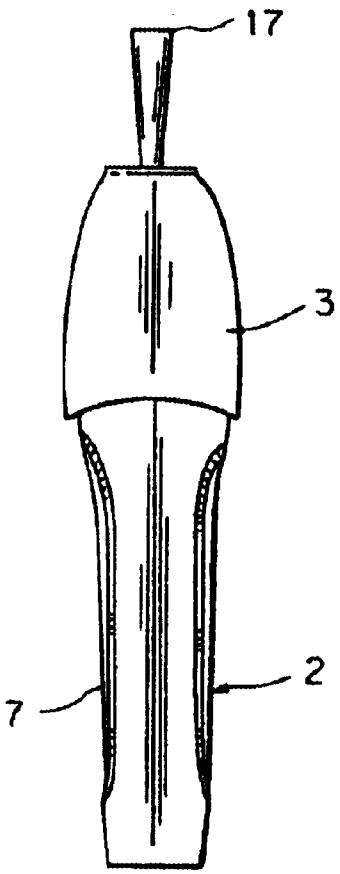
FIG. 8 is a view, corresponding to FIG. 1, with the nozzle placed on the second end.
Figure 7:
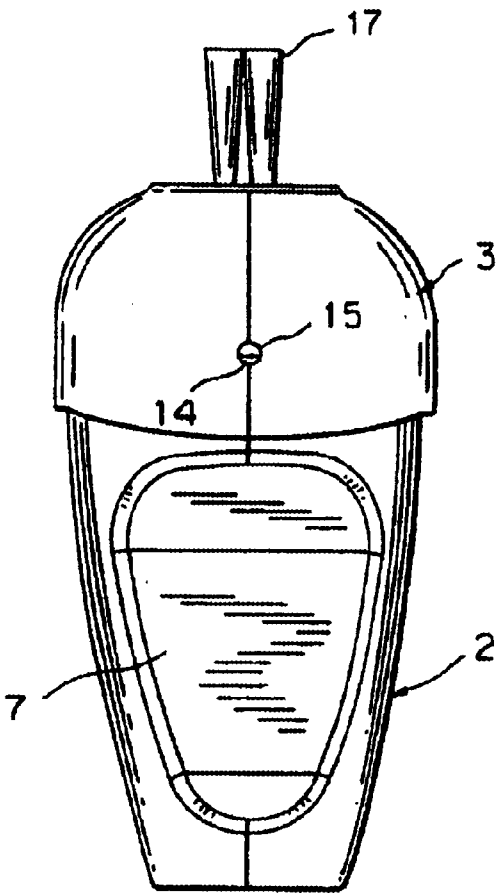
FIG. 7 is a view, corresponding to FIG. 2, with the nozzle placed on the second end.
Figure 10:
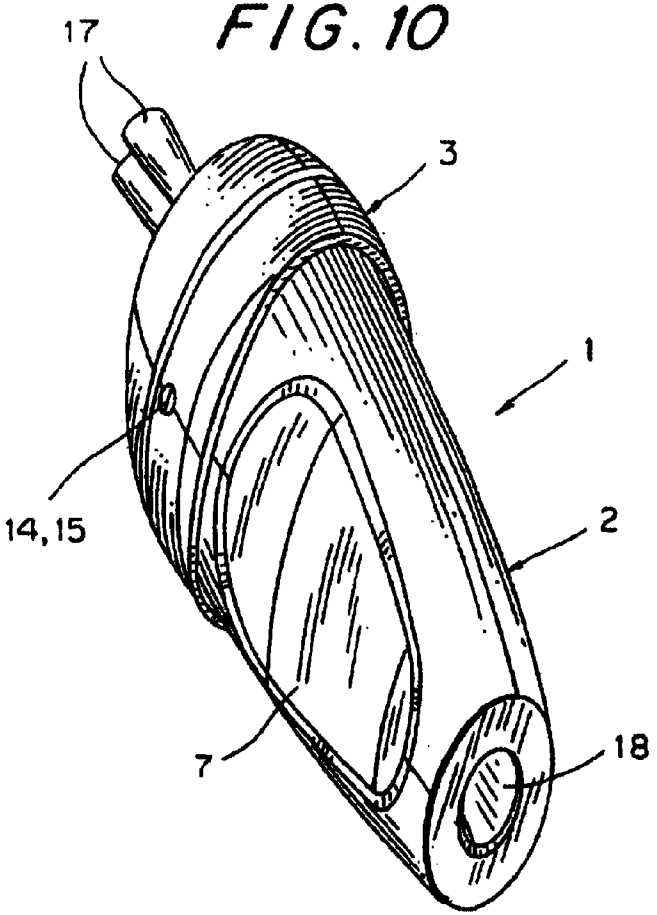
FIGS. 9 and 10 are perspective views, seen from varying angles, with the nozzle placed on the second end.
Figure 9:
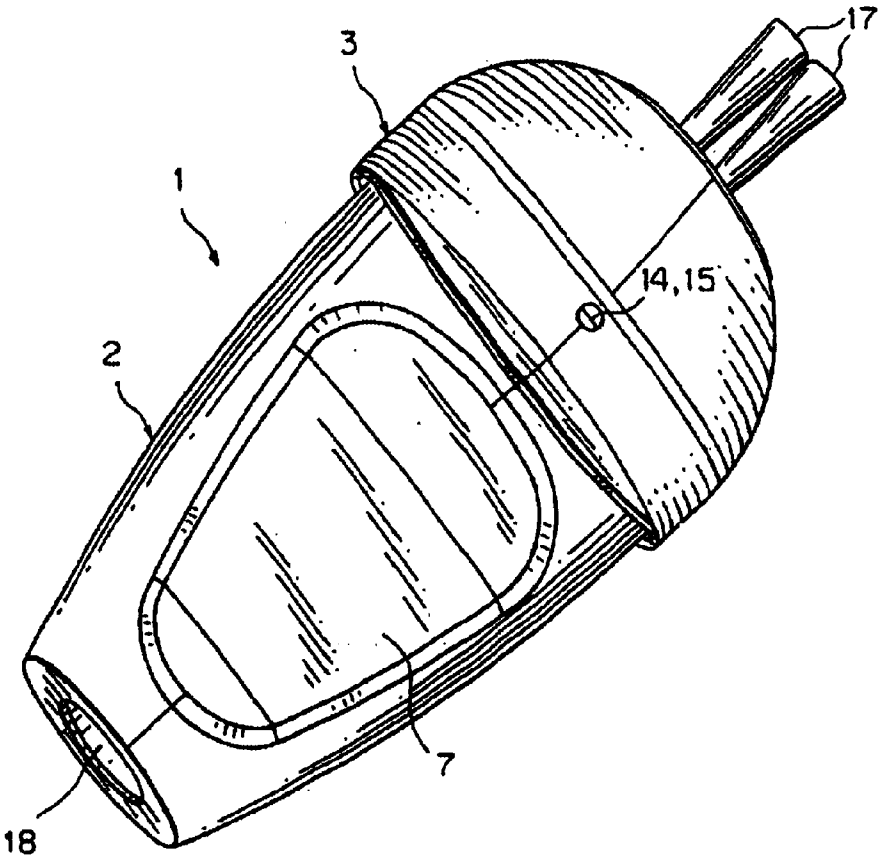

As seen in FIG. 5. a thorn 12 is formed inside the nozzle 3 around a passage, serving to pierce the membrane 11 that closes the second end 9 of the reservoir 2 when the nozzle 3 is detached for use along the rated break point 5 and placed on the second end 9 of the reservoir 2 and locked into place by way of locking noses 14 and locking recesses 15.

The passage 13 that passes through the thorn 12 discharges in the vicinity of the applicator which comprises two bundles of bristles or brushes 17 side by side. In the state prior to use seen in FIG. 5, these brushes 17 reach into a recess 18 of the reservoir 2 that extends from the first end 10 inside the reservoir 2, but is totally closed towards the interior thereof so that the brushes 17, prior to being used, are housed dryly and safely in this recess 18.

When put to use, the nozzle 3 is broken off the first end 10 of the reservoir 2 at the rated break point 5 and placed on the opposite end 9, where is locks into place by means of the locking noses 14 and the locking recesses 15. The thorn 12 pierces the membrane 11 so that the compound in the reservoir voir 2 can flow through the passage 13 towards the brushes 17 when pressure sure is exercised on the flexible walls 7 of the reservoir 2. The reservoir 2 is now virtually employed as a handle for the brushes 17 and application may take place conventionally.

A unit 1 specified above can be employed for the most varying purposes, for instance as a mascara unit as specified—or for applying lip gloss or—beyond the range of cosmetics—for instance glue.

Designs are conceivable in which a line of nozzle apertures is disposed in the middle of the applicator 17 and cross-sectionally rectangular brushes on either side of the apertures. Furthermore it is possible, if the applicator 17 is a brush, to use bristles of varying lengths. Instead of being configured as a brush, the applicator may as well consist of solid and soft material such as rubber, TPE or 2K or of solid and rigid material which is flocked or otherwise coated with a soft surface.

In keeping with another embodiment, the passages lead as far as into a central area of the applicator laterally thereof, with an approximately rectangular nozzle aperture being provided. An applicator, which is not configured as a brush, may have its surface interspersed with a plurality of passages, which may be connected to a central passage, or, by alternative, the passage may be an annular gap.

The passages may be equipped with a membrane in the shape of a bubble in the vicinity of the passages, which has to be cut open by a knife or the like prior to use.

In particular for mascara application, it can be provided that the applicator is a conventional U-shaped brush, a passage leading inside this configuration. Provision may also be made for the U-shaped configuration to extend along a central core member with a central passage discharging therein and a plurality of distributor passages extending outwards therefrom.

What is claimed is:

1. A reservoir and applicator unit, in particular for small quantities or testing purposes in the cosmetic or medicinal field, comprising a reservoir (2) for the compound that is to be applied and an applicator (17);

wherein the reservoir (2), at a first end (10), has a recess (18), which is closed towards the interior of the reservoir (2), for accommodation of the applicator (17);

wherein the reservoir (2), at a second opposite end (9), is provided with a feed inlet and outlet (8); and wherein it is possible, prior to use, to place the applicator from the first end (10) of the reservoir (2) onto the second end (9) so that the applicator (17) stands out freely from the reservoir (2) and any compound in the reservoir (2) can flow from the reservoir (2) onto the applicator (17).

2. A unit according to claim 1, wherein the applicator (17) is disposed in a nozzle (3) with a passage (13) for the compound that is to be applied.

3. A unit according to claim 2, wherein the passage (13) discharges between at least two brushes that serve as an applicator (17).

4. A unit according to claim 2, wherein the nozzle (3) is locked into place on the reservoir (2).

5. A unit according to claim 2, wherein the nozzle (3) is detachable from the reservoir (2) by rated break points (5).

6. A unit according to claim 2, wherein the feed inlet and outlet (8) is closed such that it opens automatically upon placement of the nozzle (3) together with the applicator (17).

7. A unit according to claim 6, wherein the feed inlet and outlet (8) is closed by a membrane (11) and wherein the nozzle (3) has a thorn (12) which pierces the membrane (11) when the nozzle (3) is placed on the second end (9) of the reservoir (2).

8. A unit according to claim 7, wherein the thorn (12) is formed around the passage (13) towards the applicator (17).

9. A unit according to claim 1, wherein at least sections of the reservoir (2) are compressible.

10. A unit according to claim 1, wherein at least sections of the wall of the reservoir (2) are transparent or have the color of the compound contained therein.

11. A unit according to claim 1, wherein it consists of trogamide.

* * * * *